United States Patent [19]

Bernhard

[11] 4,031,661

[45] June 28, 1977

[54] MINIATURE VEHICLE WITH MAGNETIC ENHANCEMENT OF TRACTION

[75] Inventor: Robert B. Bernhard, Port Washington, N.Y.

[73] Assignee: Aurora Products Corporation, West Hempstead, N.Y.

[22] Filed: Jan. 19, 1976

[21] Appl. No.: 650,426

[52] U.S. Cl. ..... 46/249; 46/251; 46/259

[51] Int. Cl.[2] ..... A63H 29/12; A63H 18/12

[58] Field of Search ..... 46/241, 249, 251, 257, 46/260

[56] References Cited

UNITED STATES PATENTS

| | | | |
|---|---|---|---|
| 2,838,009 | 6/1958 | Bonanno | 46/260 |
| 2,903,821 | 9/1959 | Favre | 46/241 |
| 3,159,109 | 12/1964 | Braverman | 46/251 |
| 3,752,246 | 8/1973 | Sullivan | 46/251 |

*Primary Examiner*—Hugh R. Chamblee
*Assistant Examiner*—Robert F. Cutting

[57] ABSTRACT

An arrangement for increasing the normal force exerted by an electrically powered miniature vehicle on a track in order to improve the traction of the vehicle's wheels. Flux collectors used in association with permanent magnets mounted along the sides of the vehicle and forming part of the vehicle's electric motor exert an attractive magnetic force on power rails embedded in the track, which force substantially exceeds the force provided by the magnets alone. Each of the flux collectors is made of a sheet of material which is attracted by a magnet and is mounted adjacent to the magnet surface which faces away from the motor armature. Also, each of the flux collectors extends downward to a point in close proximity to one of the power rails and includes a flange extending along at least part of the lower surface of the permanent magnet against which it is mounted.

20 Claims, 5 Drawing Figures

MINIATURE VEHICLE WITH MAGNETIC ENHANCEMENT OF TRACTION

This invention relates generally to miniature electrical vehicles which ride on a track that includes electric power rails and in particular to an electric motor arrangement for such a vehicle which provides magnetic attraction between the vehicle and the power rails so as to increase the traction of the vehicle against the track.

The prior art includes electrically powered miniature vehicles which ride on a track including at least a pair of electrical power rails, embedded in the track, that provide power for the vehicle. For example, U.S. Pat. No. 3,243,917, issued to J. E. Giammarino et al. on Apr. 5, 1966, discloses such an arrangement in which the electric motor which powers the vehicle includes a generally pancake-shaped armature that is coaxially mounted for rotation with a vertical armature shaft coupled to the wheels of the vehicle through a complex gear train. The motor also includes as its stator a pair of curved permanent magnets one of which is mounted in front of and the other behind the armature.

Although miniature vehicles of this general type have been successfully manufactured and marketed, manufacturers have been continuously striving to produce vehicles capable of quicker acceleration and higher speeds without spinning-out on curves. Among the most significent problems preventing the development of such a vehicle has been the insufficient traction force between the wheels of these vehicles and the track, which permits the wheels to spin needlessly on attempted acceleration and permits the vehicle to spin-out on curves. The relatively low traction results from the necessary low weight of miniature electrical vehicles. Moreover, merely increasing the weight of the vehicle does not solve the problem because a vehicle with a larger mass will accelerate more slowly unless a stronger motor is provided, which further increases mass and size.

In U.S. Pat. No. 3,964,206 issued June 22, 1976, I disclose an electric motor arrangement, in a miniature vehicle, which provides increased traction without increasing the weight of the vehicle. According to this arrangement, the permanent magnets of the motor extend downwardly in close proximity to the power rails so as to exert an attractive force on the power rails. This attractive force increases the normal force of the car on the track and improves the traction thereof. Although this arrangement improves acceleration and significantly reduces high-speed spin-outs on curves, the weight of the car prevents further improvements. A substantial part of the car's excess weight is due to the relatively bulky magnets required by the relatively large diameter pancake-shaped armature. Moreover, it was not possible to reduce the size of the motor to any substantial extent in order to reduce its weight, because this would reduce the normal force exerted on the track and would thereby restore the problems which the arrangement had already solved. What was needed was a substantial, further increase in the normal force of the vehicle against the track so that the weight of the vehicle could be reduced without losing traction or so that normal force and traction could be increased without any increase in mass.

It is among the objects of the present invention to provide an improved electrically operated miniature vehicle for use on a track which has magnetic material embedded in it. Generally, it is the intention of the present invention to provide an improved toy vehicle for use on conventional tracks having steel electrical rails embedded in them. More specifically, it is an object of the present invention to provide an improved electrically operated miniature vehicle which exerts an increased normal force on the track as compared with conventional vehicles of the same type and size, but without an increase in the weight or mass of the vehicle. In addition, it is an object of the present invention to provide an improved vehicle of the type described which satisfies the practical requirements of ease of assembly and disassembly, safety, simplicity of design and economy of construction.

According to the invention, the permanent magnets of the stator of an electric motor powering a miniature vehicle are provided with flux collectors which substantially increase the attractive force exerted on the power rails. Each flux collector is formed of a material which is attracted by a magnet and is mounted adjacent to a permanent magnet and to extend downwardly in close proximity to the power rails. Preferably, the flux collector extends to within 0.02 inches of a power rail and includes a portion extending along at least a portion of the lower surface of the corresponding magnet.

In accordance with an illustrative embodiment of the invention, a miniature vehicle is provided with an electric motor in which the drive shaft extends along the length of the vehicle so that the shaft can be directly coupled to the axle of the drive wheels. A generally cylindrical armature of relatively small diameter is coaxially mounted on the drive shaft for rotation therewith and a pair of magnets are oriented in compartments at opposite sides of the vehicle on either side of the armature. This permits the most advantageous use of the magnets for traction enhancement, since the entire length of each magnets can exert an attractive force on the power rails. A flux collector associated with each magnet is disposed between the magnet and a side wall of the vehicle and includes a pair of tabs at its upper end which engage the top of a side wall of the vehicle and a flange at its bottom which extends under the magnet. This flange supports the magnet within the vehicle and in close proximity to the power rails, and also enhances the magnetic force applied to the rails. It has been found that magnetic attraction can be increased further by providing a predetermined spacing between the bottom of the magnet and the top of the flange. Owing to the increase in magnetic attraction, the traction of the vehicle is increased and smaller and lighter weight magnets can be used in this configuration with a resultant improvment in the acceleration of the vehicle.

The above brief description, as well as further objects, features and advantages of the present invention are best appreciated by reference to the following detailed description when taken in conjunction with the accompanying drawing in which.

Figure 1:
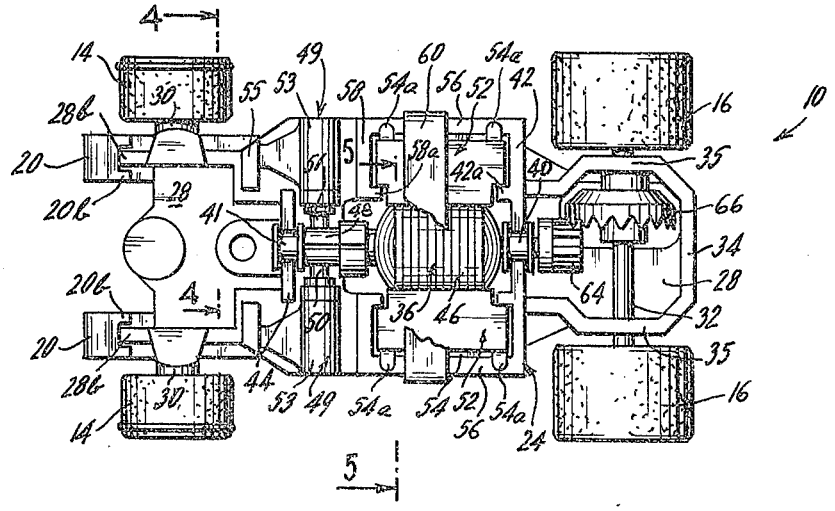
FIG. 1 is a top view, partially broken away, of a miniature vehicle, incorporating objects and features of the invention, in which the vehicle body has been removed to clearly show the detailed arrangement of the motor components.

Referring generally to the drawing, there is shown a miniature, electrically-powered vehicle designated generally by the numeral 10, which embodies objects and features of the present invention. The vehicle 10 is constructed to ride over the surface of a continuous track 12 on its front wheels 14, 14 and its rear or driving wheels 16, 16. Electric power for the vehicle is provided by a pair of continuous, parallel, electrical rails 18, 18 which are embedded in track 12 and protrude above it. The rails 18, 18 are made of a material which is attracted by a magnet (hereafter referred to as a "magnetic" material), preferably steel. A pair of pick-up shoes 20, 20 extending downward from the bottom of the vehicle 10 each engage one of rails 18, 18 and remain in sliding contact with the rails as the vehicle moves along track 12, thereby delivering electric power to the vehicle. Track 12 also includes a continuous slot (not shown) which is parallel to and between rails 18, 18 and which receives a guide pin 22 extending downward from the front of the vehicle 10. By this arrangement, the car is steered through its intended course around the track as guide pin 22 moves along the slot.

The vehicle 10 broadly comprises a supporting chassis 24, and a body 26, of any desired configuration, which is fitted to the chassis. Chassis 24, which is preferably made of a sturdy plastic material, includes a floor 28 and number of vertical walls to which the other elements of the vehicle are mounted. Specifically, each of front wheels 14, 14 is rotatably mounted on an independent axle 30 extending laterally from floor 28 at the front of the vehicle. Guide pin 22 is mounted also at the front of the vehicle between front wheels 14, 14 by conventional means not shown, and extends downward below chassis 24 and into the slot in track 12. The rear wheels 16, 16, which are of a wide configuration and covered with a foam material having a high coefficient of friction, are coaxially secured to an axle 32 on which a crown gear 66 is coaxially secured between the wheels. Axle 32 is journaled in parallel side walls 35, 35 of rear compartment 34 of vehicle 10.

Figure 4:
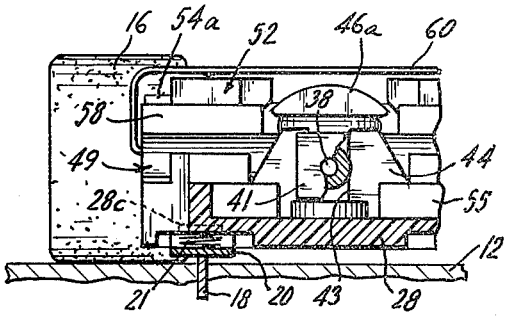
FIG. 4 is an enlarged, partial, sectional view taken along lines 4—4 of FIG. 1 and looking in the direction of the arrows.

An electric motor mounted in the chassis receives electric power from power rails 18, 18 through shoes 20, 20 and drives wheels 16, 16 to propel the miniature vehicle around the track. The electric motor includes an armature assembly 36 which forms the movable component or rotor of the electric motor and is coaxially mounted on a drive shaft 38 for rotational movement. The drive shaft 38 is oriented along the length of the vehicle 10 and terminates in a coaxially secured pinion 64 which meshes with crown gear 66 to power rear wheels 16, 16. Shaft 38 is journaled in a pair of bearings 40, 41 which are mounted, respectively, in walls 42 and 44 of chassis 24. Preferably, the bearings 40, 41 are made of brass to permit low friction rotation of the shaft 38. As can be seen in FIGS. 1 and 4, each of bearings 40, 41 includes a pair of rectangular flanges at its ends, which restrain the bearing against axial movement. The bearings are retained in vertical guideways (see guideway 43 in FIG. 4) cut in walls 42 and 44, which guideways are slightly narrower than the outside diameter of the bearing, but include a detent so that the bearings may be pressed down into the guideways and will be retained in position.

Figure 5:
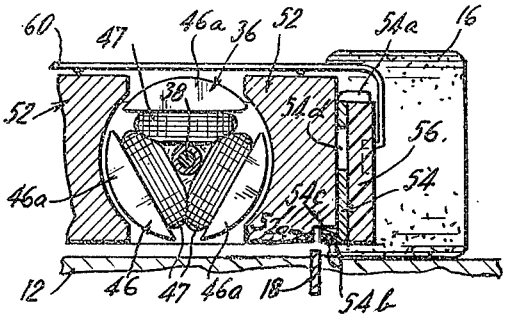
FIG. 5 is an enlarged, partial, sectional view taken along the line 5—5 in FIG. 1 and looking in the direction of the arrows showing the arrangement of the motor armature, permanent magnets and flux collectors in the vehicle.

The armature assembly 36 includes a generally cylindrical core 46, which is preferably, comprised of soft iron laminations. As best seen in FIG. 5, the core is partly cut away to form three core segments **46*a*, 46*a*, 46*a*, each of which is fitted with a winding 47 of insulated wire wound in the conventional fashion for miniature electric motors. A segmented commutator 48 is coaxially mounted on shaft 38 between bearing 41 and armature 36. The windings 47, 47, 47 are electrically connected to the commutator 48, and the commutator serves as an electrical contact for receiving electrical power to be provided to the windings, as is generally known. Electrical power is provided from rails 18, 18 to commutator 48 by means of contact shoes 20, 20 and a pair of brush assemblies 49, 49** discussed more fully below.

Brush assemblies 49, 49 are mounted on a raised portion of floor 28 on either side of commutator 48 and provide continuous electrical coupling between contact shoes 20, 20 and commutator 48. The brushes 50, 50 are solid cylindrical contact elements, preferably made of carbon, which are held in engagement with commutator 48 by springs (not shown). The brushes 50, 50 and their springs are held in housing cylinders 51, 51 which are retained by means of spring clips 53, 53. Spring clips 53, 53 each have a first end **52*a* retained by a lug 55 protruding from chassis floor 28 and are shaped to fit over cylinders 51, 51 (see FIG. 2). The second end 53*b* of each of clips 53, 53 extends downward into a hole 28*a* in floor 28 and is detachably coupled to a first end 20*a* of one of shoes 20, 20, as can be seen in FIG. 3. Each of shoes 20, 20 extends towards the front of the vehicle and curves upward over a narrow projection 28*b* of floor 28. As best seen in FIG. 1, the second end 20*b* of each of shoes 20, 20 is bifurcated and curves downward and over one of projections 28*b*, 28*b* so that the bifuractions straddle the projection. A spring 21, disposed between a recess 28*c* in the bottom floor 28 and the top surface of contact shoe 20 retains the shoe in this position and keeps the shoe in continuous engagement with rail 18 (FIG. 4). By the foregoing arrangement vehicle 10** is continually provided with electric current.

The stationary or stator component of the electric motor comprises a pair of magnet assemblies including magnets 52, 52, each provided with a flux collector 54 and mounted in a bottomless compartment of chassis 24 formed on either side of armature 36. This permits the magnet assemblies to extend through the floor of chassis 24 and to be in close proximity (preferably within 0.02 inches) to rails 18, 18 thereby providing an attractive force holding vehicle 10 to track 12. Each of the magnet compartments is formed by a portion of wall 42, a side wall 56 opposite the armature, a wall 58, and projections **42*a* and 58*a* walls 42 and 58, respectively. The magnets 52, 52 are identical except that one has its south pole on its inner surface, which is curved to conform to armature 36, and its north pole at the opposite or outer surface, whereas the other magnet has its poles oppositely oriented. As best seen in FIGS. 1 and 3, each of the magnets 52, 52 conforms to the shape of the compartments in chassis 24. Specifically, each magent is generally rectangular and has a pair of undercuts at the front and rear corners of its inner face to engage projections 42***a* and 58*a*, so that the magnets can be retained in the compartments and still be in close proximity to the armature, as shown in FIGS. 3 and 5. Each of magnets 52, 52 also includes an undercut 52*a* in its bottom to facilitate low mounting of the magnets, as will be more fully explained hereinafter. Flux collectors 54, 54 preferably made of ferrous sheet material, are each mounted between one of magnets 52, 52 and the wall 56 opposite the armature, and are effective to increase substantially the attractive force exerted by magnets 52, 52 on rails 18, 18, as will be more fully explained hereinafter. In addition, as best seen in FIGS. 1 and 5, each of flux collectors 54, 54 includes a pair of outwardly extending tabs 54*a*, 54*a* which engage the top of one of walls 56, 56 and a lower flange 54*b*, extends under one of magnets 52, 52 and into under cut 52*a*, so that the flange 54*b* is flush with the bottom of the magnet and (see FIG. 5) supports the magnet in its compartment. Each flux collector also includes a window or aperture 54*d*, which will be discussed more fully below. A spring clip 60, which extends across the tops of magnets 52, 52 and is retained in detents 62, 62 on the sides of walls 56, 56 serves to hold magnets 52, 52 down to prevent their upward movement during operation.

It has been found that the flux collectors 54, 54 provide a considerable increase in the magnetic force exerted on rails 18, 18. The particular configuration for the flux collectors shown in the drawing was arrived at by experimentation and is preferred for commercial production. It is believed that since the flux collector 54 covers most of the back of magnet 52 and is made of a ferrous material, such as steel, it represents a low reluctance path for magnetic flux or field lines. Thus, those field lines normally emanating from the back of magnet 52 into the space surrounding the vehicle are concentrated, instead, in flux collector 54 and are directed downwardly so as to emanate from the region of flange 52*b*. As can be seen in FIG. 5, the flange 52*b* is generally disposed above the rail 18, so the concentrated field lines which emanate from flange 54*b* can be directed to rail 18. This results in a strong magnetic attraction, indeed, a much stronger one than provided by the magnet along. It has been found that a further increase in magnetic attraction can be obtained by providing a space between the bottom of the magnet 52 and the upper surface of flange 54*b*. A space in the range of 0.005 to 0.007 inches provides the best results. In the illustrative embodiment, this space is provided by placing a pair of dimples 54*c*, 54*c* on each of flanges 54*b* so that the magnet rests on the dimples rather than on the surface of the flange. It is not necessary to the operation of flux collector 54 that flange 54*b* be placed within an under-cut 52*a* of magnet 52. This was merely a convenient way to mount magnet 52 lower and to make the bottom of flange 54*b* flush with the bottom of magnet 52.

Figure 2:
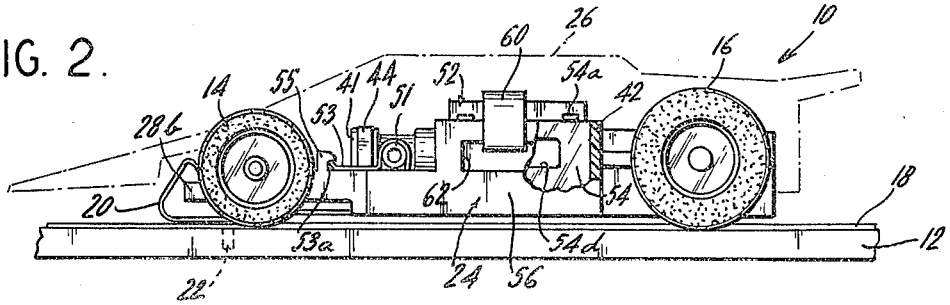
FIG. 2 is a side view, partially broken away and partially in section, of the miniature vehicle of FIG. 1 with the vehicle body indicated in phantom and shows the vehicle in operating position on a track.
Figure 3:
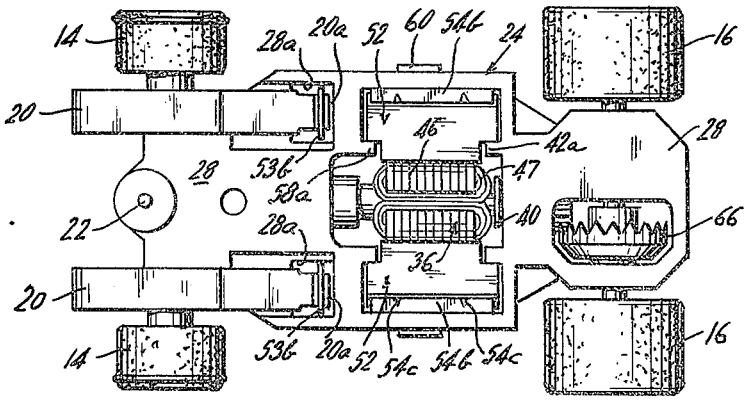
FIG. 3 is a bottom view of the miniature vehicle of FIG. 1 showing further details of construction.

It has been found that when an aperture 54*d* is provided in each of flux collectors 54, as shown in FIGS. 2 and 5, the magnetic field applied to armature 36 is strengthened. It is beleived that this results from the increase in reluctance at the top of flux collector 54 occasioned by the inclusion of aperture 54*d*. Owing to this increase in reluctance, field lines which would normally pass between the top of the flux collector and the top of the corresponding magnet find a lower reluctance path to the armature 36 and pass instead between the armature and the magnet. The resulting increased strength in the magnetic field directed to the armature increases the torque and power of the motor.

The motor arrangement described above, with the magnets 52, 52 mounted at the sides of chassis 24, is particularly efficient in providing an attractive force between the vehicle 10 and power rails 18. This is due in part to the fact that the magnets 52, 52 extend along the power rails 18 and are able to provide magnetic attraction along their entire length.

From the foregoing description, it will be appreciated how easily the electric motor can be disassembled from and reassembled to the vehicle 10. To disassemble, the clip 60 is removed from detents 62, 62 in walls 56, 56 and bearings 40, 41 are pried out of their guideways in walls 42 and 44, respectively. Once this is done, the entire armature assembly 36 (including the bearings 40, 41) and the entire stator assembly (including the magnets 52, 52 with their associated flux collectors 54, 54) can be lifted out as a single unit. This is so because the magnets 52, 52 are attracted to the iron core 46 of the armature, and flux collectors 54, 54 are held to the magnets 52, 52, also be magnetic attraction. Once the armature is removed, brushes 50, 50 are forced out of their holders under spring pressure. To reassemble the motor, the rotor and stator components are once again assembled as a unit and placed in position on chassis 28. Next, the bearing 40 is pressed into its guideway as pinion 64 is meshed with crown gear 66, and bearing 41 is pressed into its guideway after pushing brushes 50, 50 back into their holders. The replacement of spring clip 60 completes the reassembly procedure.

Although a specific embodiment of the invention has been shown for illustrative purposes, it will be appreciated by one skilled in the art that many modifications, additions and substitutions are possible without departing from the scope and spirit of the invention.

What is claimed is:

1. In a miniature vehicle of the type having a supporting chassis, at least one driving wheel mounted to the chassis, and a pair of electrical pick-up shoes, said driving wheel adapted to engage a track including electric power means therein made of a magnetic material engageable with said pick-up shoes, the combination of:

an electric motor mounted in said chassis for powering said at least one driving wheel, including a rotatably mounted drive shaft extending axially along the length of said vehicle and coupled to said at least one driving wheel, an armature coaxially mounted on said drive shaft having a plurality of windings, a pair of magnet assemblies mounted in said chassis on opposite sides of said armature and forming the stationery magnetic component of said motor, each of said magnet assemblies including a magnet mounted in said chassis with no portion of said chassis between the bottom of said magnet assemblies and the electric power means of said track; and means for coupling said armature to said pick-up shoes for providing electric power to said motor;

said magnet assemblies and said electric power means cooperating when said miniature vehicle is in said track to provide a magnetic force holding said vehicle to said track, thereby increasing the traction of said at least one driving wheel on said track.

2. The apparatus of claim 1 wherein said chassis further includes a pair of bottomless compartments formed on opposite sides of said armature, each of said compartments being adapted to receive one of said magnet assemblies and having at least one wall spaced from said armature, each of said magnet assemblies further including a magnet-holding member including means for engaging said wall of said compartment and means for engaging said magnet for supporting said magnet in said compartment.

3. The apparatus of claim 2 wherein said magnet-holding member is made of a magnetic material and is thereby operative to increase the magnetic force holding said vehicle to said track.

4. The apparatus of claim 3, wherein said magnet-holding member is formed with an aperture to reduce the attraction of magnetic flux from the vicinity of said armature to said magnet-holding member.

5. The apparatus of claim 2 wherein said means for engaging said magnet includes a flange formed at the bottom of said magnet-holding member said flange engaging the bottom of said magnet to hold said magnet in said compartment.

6. The apparatus of claim 5 wherein said magnet-holding member is made of a magnetic material and has an aperture formed therein, and further includes means for maintaining the spacing between said flange and the bottom of said magnet in the range of approximately 0.005 to approximately 0.007 inches so that said magnet-holding member intensifies the magnetic force holding said vehicle to said track.

7. The apparatus of claim 2 wherein said means for engaging said magnets includes means for engaging the bottom of said magnet and for maintaining said magnet engaging means and the bottom of said magnet is spaced relationship.

8. The apparatus of claim 7 wherein the spacing between said magnet engaging means and the bottom of said magnet is in the range of approximately 0.005 to approximately 0.007 inches.

9. In a miniature vehicle adapted to ride on a track having electric power means therein made of a magnetic material, said vehicle including a chassis, an electric motor mounted in said chassis having a rotor assembly and a plurality of magnets forming part of the stator assembly therof, at least one driving wheel mounted in said chassis, said at least one driving wheel being operatively coupled to the rotor assembly and arranged to engage said track and a pair of electrical pick-up shoes engageable with said track for energizing said motor; the improvement comprising at least one flux collector made of magnetic material and mounted adjacent to one of said magnets, said at least one flux collector extending downwardly to be in a location proximate to said electric power means when said vehicle is on said track so that an attractive force is provided between said at least one flux collector and said electric power means thereby increasing the traction of said at least one driving wheel on said track.

10. The vehicle of claim 9 wherein said at least one flux collector includes a member projecting under said magnet to be between at least a portion of said magnet and said electric power means when said vehicle is on said track.

11. The vehicle of claim 10, wherein said at least one flux collector is formed with an orifice therein.

12. The vehicle of claim 10 further including means for maintaining a predetermined spacing between the portion of said member projecting under said magnet and the bottom of said magnet.

13. The vehicle of claim 12 wherein said predetermined spacing is approximately in the range of 0.005 to 0.007 inches.

14. In a miniature vehicle provided with a supporting chassis and at least one driving wheel secured to an axle rotatably mounted in the chassis, said at least one driving wheel being adapted to engage a track having electric power means therein made of a magnetic material, a pair of electrical pick-up shoes engageable with said electric power means, an electric motor mounted in said chassis for powering said at least one driving wheel, and energized through said electrical pick-up shoes, comprising:

a rotatably mounted drive shaft extending axially along the length of said vehicle and adapted to be coupled directly to said axle;

an armature coaxially mounted on said drive shaft having a plurality of windings;

a pair of magnets mounted in said chassis on opposite sides of said armature and forming part of the stator of said motor; and a pair of flux collectors each made of magnetic material and each mounted adjacent to a corresponding one of said magnets and away from said armature, each of said flux collectors extending downwardly to a location proximate the bottom of a corresponding one of said magnets to be in close proximity to one of said electric power means when said vehicle is on said track so that an attractive force is provided between each of said flux collectors and a corresponding one of said power means thereby increasing the traction of said at least one driving wheel on said track.

15. The vehicle of claim 14 wherein each of said flux collectors includes a member projecting under said magnet to be between at least a portion of said magnet and said electric power means when said vehicle is on said track.

16. The vehicle of claim 15, wherein said flux collectors are each formed with an orifice therein.

17. The vehicle of claim 15 further including means for maintaining a predetermined spacing between the portion of said member projecting under said magnet and the bottom of said magnet.

18. The vehicle of claim 17 wherein said predetermined spacing is approximately in the range of 0.005 to 0.007 inches.

19. In a miniature electrically powered vehicle of the type having a supporting chassis, a pair of driving wheels mounted to the chassis, and a pair of electrical pick-up shoes, and a track having electric power means therein made of a magnetic material and engageable with said pick-up shoes, the improvement comprising an electric motor mounted in said chassis for powering said driving wheels, including a rotatably mounted drive shaft extending axially along the length of said vehicle and coupled to said driving wheels, an armature coaxially mounted on said drive shaft having a plurality of windings, a pair of magnet assemblies extending axially along the length of said vehicle and mounted in said chassis on opposite sides of said armature, each of said magnet assemblies including a magnet mounted in said chassis forming the stationary magnetic component of said motor, means for coupling said armature to said pick-up shoes for providing electric power to said motor, said magnet assemblies and said electric power means cooperating when said miniature vehicle is on said track to provide a magnetic force holding said vehicle to said track, thereby increasing the traction of said driving wheels on said track.

20. The apparatus of claim 19 wherein said chassis further includes a pair of bottomless compartments formed on opposite sides of said armature, each of said compartments having at least one wall spaced from said armature, each of said magnet assemblies further including a member disposed between said magnet and said compartment wall, said member having a first surface contacting said compartment wall and a second surface contacting said magnet.

* * * * *

Disclaimer 4,031,661.—*Robert B. Bernhard,* Port Washington, N.Y. MINIATURE VEHICLE WITH MAGNETIC ENHANCEMENT OF TRACTION. Patent dated June 28, 1977. Disclaimer filed Mar. 15, 1982, by the assignee, *Aurora Products Canada, Ltd.*

The term of this patent subsequent to June 22, 1993, has been disclaimed.

[*Official Gazette June 29, 1982.*]